US010612899B2

(12) United States Patent
Grunder et al.

(10) Patent No.: US 10,612,899 B2
(45) Date of Patent: Apr. 7, 2020

(54) WARHEAD

(71) Applicant: SAAB BOFORS DYNAMICS SWITZERLAND LTD., Thun (CH)

(72) Inventors: Bruno Grunder, Heimberg (CH); Markus Conrad, Thun (CH); Christian Herren, Liebefeld (CH)

(73) Assignee: Saab Bofors Dynamics Switzerland Ltd., Thun (CH)

( * ) Notice: Subject to any disclaimer, the term of this patent is extended or adjusted under 35 U.S.C. 154(b) by 0 days.

(21) Appl. No.: 16/068,180

(22) PCT Filed: Jan. 15, 2016

(86) PCT No.: PCT/CH2016/000005

§ 371 (c)(1),
(2) Date: Jul. 5, 2018

(87) PCT Pub. No.: WO2017/120684

PCT Pub. Date: Jul. 20, 2017

(65) Prior Publication Data

US 2019/0033047 A1 Jan. 31, 2019

(51) Int. Cl.

| | |
|---|---|
| ***F42B 12/32*** | (2006.01) |
| ***F42B 12/24*** | (2006.01) |
| ***F42B 12/44*** | (2006.01) |

(52) U.S. Cl.

CPC ..... *F42B 12/32* (2013.01); *F42B 12/24* (2013.01); *F42B 12/44* (2013.01)

(58) Field of Classification Search

CPC ..... F42B 12/44; F42B 12/24; F42B 12/32

USPC ..... 102/473, 45, 475, 491–497

See application file for complete search history.

(56) References Cited

U.S. PATENT DOCUMENTS

| | | | | | |
|---|---|---|---|---|---|
| 791,679 | A * | 6/1905 | Edmunds | F42B 12/32 | 102/495 |
| 1,006,875 | A * | 10/1911 | Puff | F42B 12/32 | 102/494 |
| 3,498,224 | A * | 3/1970 | Cordle | F42B 12/32 | 102/496 |
| 3,566,794 | A * | 3/1971 | Pearson | F42B 12/22 | 102/493 |
| 3,799,054 | A * | 3/1974 | LaRocca | F42B 12/22 | 102/491 |
| 3,815,504 | A * | 6/1974 | Tieben | F42B 12/32 | 102/496 |
| 3,853,059 | A * | 12/1974 | Moe | F41H 11/02 | 102/493 |
| 3,945,321 | A * | 3/1976 | Mayer | F42B 12/32 | 102/496 |

(Continued)

FOREIGN PATENT DOCUMENTS

| | | |
|---|---|---|
| DE | 2344173 A1 | 4/1975 |
| DE | 2557676 A1 | 6/1977 |

(Continued)

*Primary Examiner* — John Cooper

(74) *Attorney, Agent, or Firm* — Rankin, Hill & Clark LLP

(57) ABSTRACT

Warhead (1) comprising a tubular structure with a front region (2), a rear region (3), an outer wall portion (4), an inner wall portion (5) and a central cavity (6), whereby the outer wall portion (4) comprises a multitude of pre-shaped first fracture elements (7) having a non-spherical shape and a multitude of non-cohesive pre-shaped second fracture elements (9) having a spheroidal shape.

19 Claims, 3 Drawing Sheets

(56) References Cited

U.S. PATENT DOCUMENTS 4,129,061 A * 12/1978 Bedall ..... F42B 12/32 102/496
4,292,829 A * 10/1981 Weber ..... B22F 7/064 72/76
4,305,333 A * 12/1981 Altenau ..... F42B 12/22 102/306
4,312,274 A * 1/1982 Zernow ..... F42B 12/22 102/493
4,327,643 A * 5/1982 Lasheras Barrios .... F42B 12/32 102/473
4,381,692 A * 5/1983 Weintraub ..... F42B 12/44 102/364
4,516,501 A * 5/1985 Held ..... F42B 12/22 102/275.5
4,655,139 A * 4/1987 Wilhelm ..... F42C 19/095 102/309
4,664,035 A * 5/1987 Osofsky ..... F42B 12/22 102/493
4,745,864 A * 5/1988 Craddock ..... F42B 12/22 102/491
4,982,668 A * 1/1991 Bender ..... F42B 12/32 102/495
5,313,890 A * 5/1994 Cuadros ..... F42B 12/32 102/393
5,337,673 A * 8/1994 Koontz ..... F42B 12/22 102/389
5,540,156 A * 7/1996 Fong ..... F42B 12/22 102/306
5,544,589 A * 8/1996 Held ..... F42B 12/204 102/475
6,145,441 A * 11/2000 Woodall ..... F42B 8/14 102/370
6,484,642 B1 * 11/2002 Kuhns ..... F42B 12/24 102/493
6,962,113 B1 * 11/2005 Carlson ..... F42B 12/22 102/389
6,966,265 B2 * 11/2005 Ronn ..... F42B 12/32 102/389
7,624,682 B2 * 12/2009 Lloyd ..... F42B 12/06 102/497
7,743,707 B1 * 6/2010 Melin ..... F42C 19/0842 102/493
7,886,667 B1 * 2/2011 Baker ..... F42B 12/22 102/495
8,161,884 B1 * 4/2012 Kokodis ..... F42B 12/24 102/476
8,973,503 B2 * 3/2015 Dunaway ..... F42B 12/24 102/495
9,759,533 B2 * 9/2017 Bruno ..... F42B 12/32
9,784,541 B1 * 10/2017 Genson ..... F42B 12/207
2003/0164108 A1 * 9/2003 Ronn ..... F42B 12/10 102/473
2003/0167956 A1 * 9/2003 Kellner ..... F42B 12/204 102/517
2004/0011238 A1 * 1/2004 Ronn ..... F42B 12/32 102/492
2005/0067072 A1 3/2005 Vavrick
2005/0087088 A1 * 4/2005 Lacy ..... F42B 12/24 102/495
2007/0277914 A1 * 12/2007 Hugus ..... C06B 21/005 149/19.92
2009/0211484 A1 * 8/2009 Truitt ..... F42B 12/32 102/497
2010/0199875 A1 * 8/2010 Weihrauch ..... F42B 12/208 102/492
2013/0255524 A1 10/2013 Simon et al.
2014/0182474 A1 * 7/2014 Dunaway ..... F42B 12/24 102/374
2017/0299964 A1 * 10/2017 Manz ..... F42B 12/24

FOREIGN PATENT DOCUMENTS

FR 2992408 A1 12/2013
GB 1171362 A 11/1969
WO 2014014895 A2 1/2014

* cited by examiner

WARHEAD

BACKGROUND OF THE INVENTION

1. Field of the Invention

The invention relates to a warhead.

2. Description of the Related Art

A method for manufacturing a fragmentation casing for warheads and the like is known from U.S. Pat. No. 4,129,061 BEDALL ET AL. In an outer cylindrical recess of a shell base body a single layer of heavy metal balls together with metal powder hardenable by sintering is introduced and compressed to form a stable sleeve-shaped splinter mantel around the shell base body.

This known manufacturing process requires heat and pressure for sintering the material in which the single layer of metal balls is embedded. Furthermore it is limited to one type of preformed splinters, namely to metal balls of uniform size being arranged in a single layer.

A hollow charge warhead is known from GB 1,171,362 which comprises pre-shaped fragments in the form of metal balls. It further discloses that spherical fragments together with incendiary bodies may be embedded in a synthetic resin. The hollow charge is said to be effective against hard targets and the metal balls are said to be effective against soft targets. Therefore only one type of pre-shaped fragments for soft targets in the form of balls is disclosed. Another drawback of this known warhead consists in the fact that its fragmentation casing comprising the metal balls being contained within a cylindrical housing, i.e. does not form the outer surface of the warhead, thereby diminishing the effect of the fragments.

A configured blast fragmentation warhead is known from U.S. Pat. No. 3,853,059 which comprises several fragment layers encased in a shroud, i.e. the several fragment layers do not form the outer surface of the warhead, thereby diminishing the effect of the fragments. No spherical pre-shaped fragments are disclosed.

BRIEF SUMMARY OF THE INVENTION

It is an object of the invention to provide a warhead allowing a combination of manageable complexity and simplified manufacturing.

The invention solves the posed problem with a warhead as disclosed and claimed herein.

The advantages of the warhead according to the invention are the following:

- Dual action of the two types of fragments (spherical fragments for soft targets and non-spherical fragments for hard targets);
- Ease of manufacture; and
- Different material selection for the different types of fragments.

Further advantageous embodiments of the invention can be commented as follows:

In a special embodiment the multitude of the first fracture elements is in the form of a cohesive structure. The cohesive structure of pre-shaped first fracture elements is used in the present application as definition of a construct consisting of a plurality of the first fracture elements having a non-spherical shape and being connected with each other, by means of e.g. single cross-braces that form a mesh. Such a cohesive structure can be formed of the first structure elements and the cross-braces either as a one-piece structure or a multi-part structure. Alternatively, the cohesive structure of the multitude of the first structure elements can be formed by as a single layer provided with grooves therein, so that the single first fracture elements are formed by the grooves in the layer.

In a further embodiment the warhead comprises a first matrix in which the first fracture elements are embedded.

In a further embodiment the warhead comprises a second matrix in which the second fracture elements are embedded.

In another embodiment the warhead comprises a single matrix in which the first fractures elements and the second fracture elements are embedded.

In a further embodiment the first matrix comprises the following materials: polymer and/or reactive metal foam.

In a further embodiment the second matrix comprises the following materials: polymer and/or reactive metal foam.

In another embodiment the single matrix comprises the following materials: polymer and/or reactive metal foam.

In a further embodiment the reactive metal foam comprises aluminium and/or magnesium as basic material. The combustible metal foam comprising aluminium and/or magnesium allows the advantage of weight reduction of the warhead and an additional significant blast-effect.

In a further embodiment the first fracture elements are formed to a cohesive structure by thermal sintering.

In a further embodiment the thickness of the cohesive structure of the first fracture elements is variable over the structure, whereby the cohesive structure has a maximal thickness $D_{max}$ and a minimal thickness $D_{min}$.

In a further embodiment the cohesive structure of the first fracture elements has a minimal thickness in the range between 0.7 mm and 2.0 mm. The minimal thickness of 0.7 mm is suitable for non-penetrating systems, whereby the minimal thickness of at least 2.0 mm is suitable for perforators.

In a further embodiment the cohesive structure of the first fracture elements is formed as a mesh.

In a further embodiment the second fracture elements are provided in the region of the maximal thickness $D_{max}$ of the cohesive structure of the first fracture elements only.

In another embodiment the second fracture elements are provided in the region of the minimal thickness $D_{min}$ of the cohesive structure of the first fracture elements only.

In again another embodiment the second fracture elements are provided in the regions of the minimal thickness $D_{min}$ and in the region the maximal thickness $D_{max}$ of the cohesive structure of the first fracture elements.

In a further embodiment the first fracture elements and second fracture elements are arranged in a single plane of the outer wall portion.

In a further embodiment the second matrix is provided in the regions of the minimal thickness $D_{min}$ and in the region the maximal thickness $D_{max}$ of the cohesive structure of the first fracture elements.

In another embodiment the second matrix is provided in the region of the maximal thickness $D_{max}$ of the cohesive structure of the first fracture elements only.

In again a further embodiment the second matrix is provided in the region of the minimal thickness $D_{min}$ of the cohesive structure of the first fracture elements only.

The several above mentioned arrangements of the first fracture elements, the second fracture elements and the matrix relatively to each other allow a structural integrity with a minimal loss-of-material as well as an optimized lethality due to the control of the form and the energy of the first and second fracture elements.

In a further embodiment the first fracture elements and the second fracture elements comprise different materials.

In a further embodiment the first fracture elements are shaped at least partly as polyhedrons, and in particular have a cuboid, parallelepipedic or tetrahedral shape. This shape is more efficient for hard targets, like vehicles.

In a further embodiment the first fracture elements and the second fracture elements comprise a material with a density of at least 4 g/cm$^3$.

In a further embodiment the first fracture elements comprise a metal, metallic alloy or metal carbide, preferably steel, tungsten, tungsten carbide or aluminum.

In a further embodiment the second fracture elements comprise: steel, tungsten or molybdenum.

In a further embodiment the warhead is a hollow charge warhead.

In a further embodiment at least a part of the outer wall portion containing the first and second fracture elements is tapering towards the front. This arrangement of the conical portion and the cylindrical portion allows the front spray of fragments by explosion of the explosive charge of the warhead.

In another embodiment at least a part of the outer wall portion containing the first and second fracture elements is tapering towards the rear. This arrangement of the conical portion and the cylindrical portion allows the back spray of fragments by explosion of the explosive charge of the warhead.

In a further embodiment the tapering is generally conical with a half cone angle $\varphi_1$ being greater than 5 degrees.

In a further embodiment the tapering is generally conical with a half cone angle $\varphi_1$ being smaller than 7 degrees.

Typically, the generally conical tapering has a half cone angle $\varphi_1$ being 6 degree.

In a further embodiment the first fracture elements are arranged in a single layer.

In a further embodiment the second fracture elements are arranged in a single layer.

These above described embodiments have an advantage of a simplified manufacturing and—resulting therefrom—low costs of manufacture.

In a further embodiment a perforator is attached to the front region.

In a further embodiment the tubular structure comprises a discontinuity in the area of the outer wall portion containing the first and second fracture elements, whereby this discontinuity is running radially to the tubular structure.

In a further embodiment the outer wall portion containing the first and second fracture elements comprises a hollow generally cylindrical portion and a hollow generally conical portion.

In a further embodiment the generally cylindrical portion is arranged between the generally conical portion and the rear end. This arrangement of the conical portion and the cylindrical portion allows the front spray of fragments by explosion of the explosive charge of the warhead.

In another embodiment the generally conical portion is arranged between the generally cylindrical portion and the rear end. This arrangement of the conical portion and the cylindrical portion allows the back spray of fragments by explosion of the explosive charge of the warhead.

In a further embodiment the generally conical portion has a full cone angle of $\varphi_2$ in the range of 4 to 30 degree, preferably in the range of 6 to 20 degree.

In a further embodiment the discontinuity has a form of a bend, preferably of a sharp bend.

In a further embodiment the bend has a minimal bend of 4 degrees.

In a further embodiment the bend has a maximal bend of 15 degrees.

In a further embodiment the warhead does not comprise any outer layer over the first fracture elements.

In a further embodiment the warhead does not comprise any outer layer over the second fracture elements.

In a further embodiment at least a part of the outer wall portion does not contain any fracture elements.

In a further embodiment the weight ratio of the multitude of the first fracture elements and the multitude of the second fracture elements is in the range from 1:10 to 10:1.

Definitions

"Perforator": A perforator is a specially designed part of a warhead which is able to perforate structures like bricks, sand and concrete by means of their kinetic energy.

"Sintering": Sintering is the process of compacting and forming a solid mass of material by heat and/or pressure without melting it to the point of liquefaction.

"Reactive metal foam": A metal foam is a cellular structure consisting of a solid metal and a large volume fraction of gas-filled pores. The reactive metal foam comprises combustible materials as e.g. aluminium and/or magnesium as basic material.

"Fragments": The term "fragments" means in the present specification any pre-shaped fragmentations or splinters made of various hard or hardenable materials.

A BRIEF DESCRIPTION OF THE DRAWINGS

Several embodiments of the invention will be described in the following by way of example and with reference to the accompanying drawings in which.

Figure 3A:
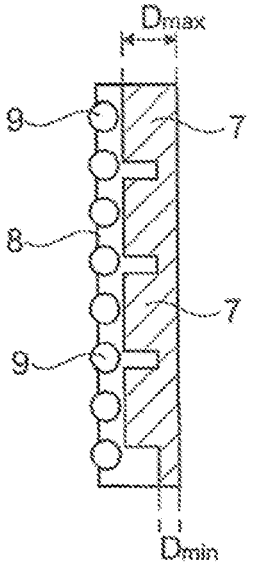
Figure 3B:
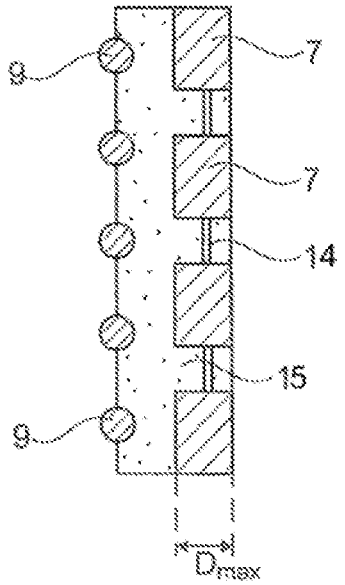
Figure 3C:
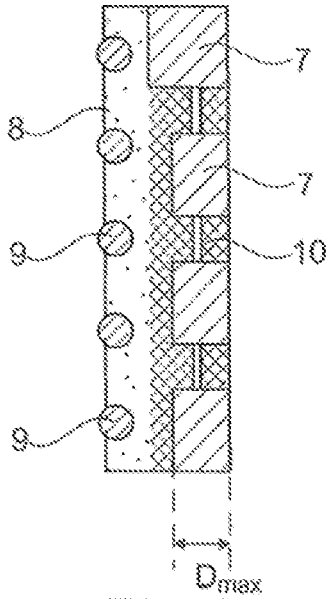
Figure 4:
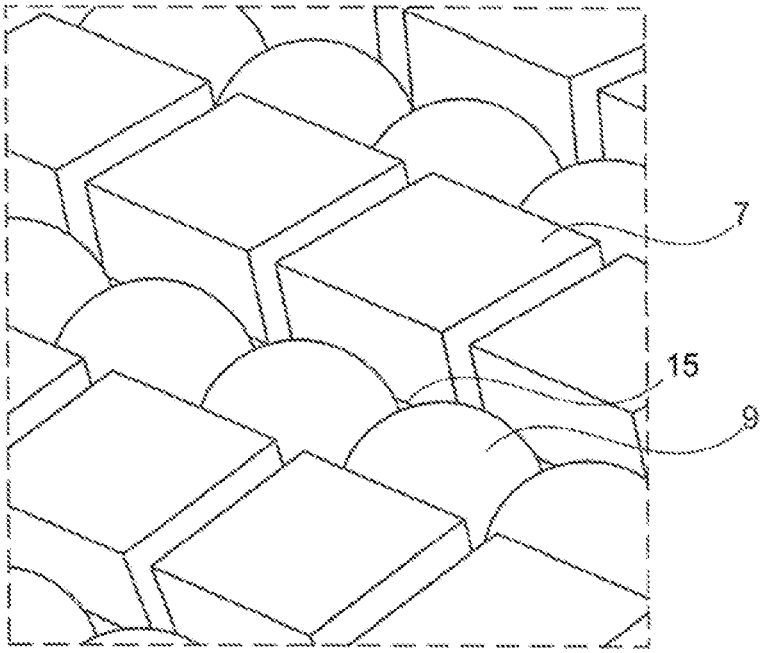

FIGS. 3*a* to 3*c* illustrate a schematical view of the cross-section of the wall of the tabular structure of several embodiments of the warhead according to the invention;

FIG. 4 illustrates a schematical perspective view of another arrangement of the first and seconds fracture elements over the wall of the tabular structure of the warhead.

DETAILED DESCRIPTION OF THE INVENTION

Figure 1:
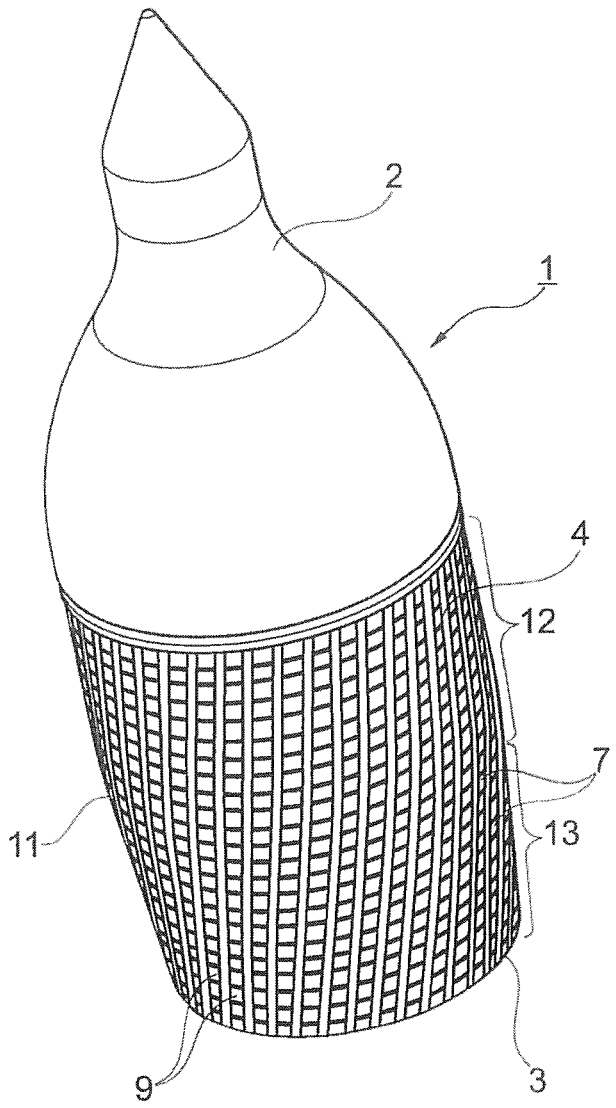
FIG. 1 illustrates a perspective view of an embodiment of the warhead according to the invention.

FIG. 1 illustrates an embodiment of the warhead 1 comprising a tubular structure with a front region 2, a rear region 3 and an outer wall portion 4. The outer wall portion 4 is partially provided with a multitude of pre-shaped first fracture elements 7 having a cuboid shape and a multitude of non-cohesive pre-shaped second fracture elements 9 having a spheroidal shape. The multitude of the first fracture elements 7 is in the form of a cohesive structure. The cohesive structure is formed as a single layer comprising several grooves provided in the layer and so forming the multitude of the single first fracture elements 7. The multitude of the second fracture elements 9 having a spheroidal shape are provided between the single first fracture elements 7, i.e. in the grooves of the layer.

The embodiment of the warhead 1 according to the FIG. 1 is further comprising a discontinuity 11 running radials to the tubular structure of the warhead 1 and having a form of a bend. This discontinuity is formed by the generally cylindrical portion 12 of the outer wall portion 4 and by the generally conical portion 13 of the outer wall portion 4, whereby the conical portion 13 is arranged adjoining the cylindrical portion 12.

Figure 2:
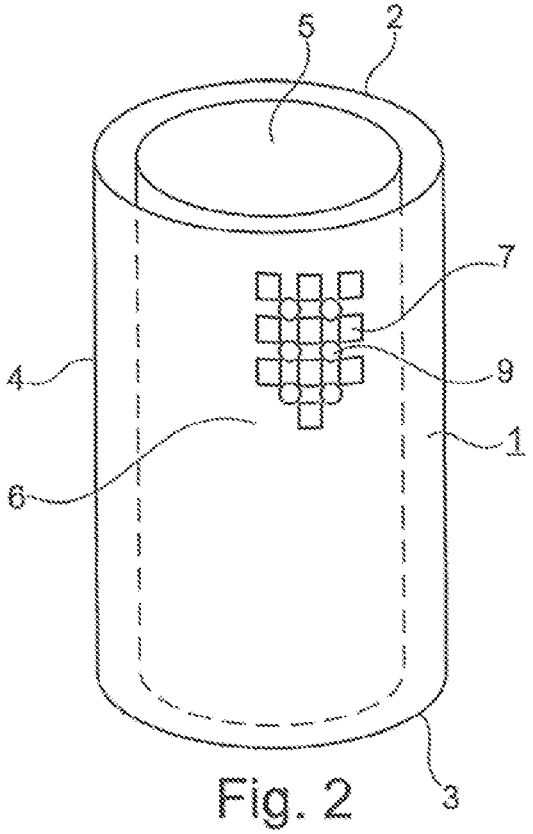
FIG. 2 illustrates a schematical view of an embodiment of the warhead according to the invention.

FIG. 2 illustrates an embodiment of the warhead 1 comprising a tubular structure with a front region 2, a rear region 3, an outer wall portion 4, an inner wall portion 5 and a central cavity 6. The outer wall portion 4 is provided with a multitude of first fracture elements 7 and the second fracture elements 9 being provided between the first fracture elements 9.

FIG. 3*a* illustrates a cross-section of the wall of the tubular structure being provided with a multitude of the first fracture elements 7 and a multitude of the second fracture elements 9. The multitude of the first fracture elements 7 is in the form of a cohesive structure. The cohesive structure is formed as a single layer comprising grooves provided in the layer and so forming the multitude of the single first fracture elements 7. The cohesive structure has a maximal thickness $D_{max}$ in the region of the single fracture elements and has a minimal thickness $D_{min}$ in the region of the grooves. The multitude of the second fracture elements 9 are provided over the first fracture elements 7 and are embedded in a second matrix 8, being provided over the first fracture elements 7.

FIG. 3*b* illustrates a cross-section of the wall of the tubular structure being provided with a multitude of the first fracture elements 7 and a multitude of the second fracture elements 9. The multitude of the first fracture elements 7 consist of plurality of single elements with a non-spherical form and a maximal thickness $D_{max}$, which are connected with each other by means of single cross-braces 14 to form a cohesive structure. The multitude of the second fracture elements 9 are provided over the first fracture elements 7. The first fracture elements 7 and the second fracture elements 9 are embedded in a single matrix 15.

FIG. 3*c* illustrates a cross-section of the wall of the tubular structure being provided with a multitude of the first fracture elements 7 and a multitude of the second fracture elements 9. The multitude of the first fracture elements 7 consist of plurality of single elements with a non-spherical form and a maximal thickness $D_{max}$, which are connected with each other by means of single cross-braces 14 to form a cohesive structure. The multitude of the first fracture elements 7 are embedded in a first matrix 10. The multitude of the second fracture elements 9 are provided over the first fracture elements 7. The second fracture elements 9 are embedded in a second matrix 8 consisting of material being different to the material of the first matrix 10.

FIG. 4 illustrates a perspective view of the wall of the tubular structure being provided with a multitude of first fracture elements 7 and second fracture elements 9. The multitude of first fracture elements 7 consists of a plurality of cubical-shaped elements. The multitude of the second fracture elements 9 consists of a plurality of spherical elements. The first and seconds elements are arranged in a single plane of the outer wall portion of the tubular structure of the warhead, and are embedded in a single matrix 15.

Although the invention has been described in conjunction with specific embodiments thereof, it is evident that many alternatives, modifications and variations will be apparent to those skilled in the art. Accordingly, it is intended to embrace all such alternatives, modifications and variations that fall within the scope of the appended claims.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination or as suitable in any other described embodiment of the invention. Certain features described in the context of various embodiments are not to be considered essential features of those embodiments, unless the embodiment is inoperative without those elements.

The invention claimed is:

1. A warhead comprising a tubular structure with a front region, a rear region, an outer wall portion, an inner wall portion and a central cavity, wherein the outer wall portion is provided with a multitude of pre-shaped first fracture elements having a non-spherical shape and a multitude of non-cohesive pre-shaped second fracture elements having a spheroidal shape, wherein a plurality of the multitude of pre-shaped first fracture elements are connected to each other to form a cohesive structure, wherein at least a part of the outer wall portion of the warhead does not contain any fracture elements, wherein the warhead further comprises a matrix in which the multitude of second fracture elements are embedded, wherein the warhead does not comprise any outer layer over the multitude of second fracture elements.

2. The warhead according to claim 1, wherein the cohesive structure is a single layer provided with grooves that define the multitude of first fracture elements.

3. The warhead according to claim 1, wherein the warhead further comprises a second matrix in which the multitude of first fracture elements are embedded.

4. The warhead according to claim 3, wherein the second matrix comprises at least one of a polymer and a reactive metal foam.

5. The warhead according to claim 1, wherein the multitude of first fracture elements are also embedded in the matrix.

6. The warhead according to claim 5, wherein the matrix comprises at least one of a polymer and a reactive metal foam.

7. The warhead according to claim 1, wherein the matrix comprises a polymer.

8. The warhead according to claim 1, wherein the matrix comprises a reactive metal foam.

9. The warhead according to claim 8, wherein the reactive metal foam comprises at least one of aluminum and magnesium as a basic material.

10. The warhead according to claim 1, wherein the cohesive structure of the multitude of first fracture elements is a mesh.

11. The warhead according to claim 1, wherein the multitude of first fracture elements and the multitude second fracture elements are arranged in a single layer on the outer wall portion of the warhead.

12. The warhead according to claim 1, wherein the multitude of first fracture elements comprise a different material than the multitude of second fracture elements.

13. The warhead according to claim 1, wherein the multitude of first fracture elements are shaped at least partly as polyhedrons.

14. The warhead according to claim 1, wherein the warhead is a hollow charge warhead.

15. The warhead according to claim 1, wherein the multitude of first fracture elements are arranged in a single layer.

16. The warhead according to claim 1, wherein the multitude of second fracture elements are arranged in a single layer.

17. The warhead according to claim 1, wherein the tubular structure of the warhead comprises a discontinuity in an area of the outer wall portion of the warhead, wherein the discontinuity runs radially relative to the tubular structure of the warhead, and wherein the multitude of first fracture elements and the multitude of second fracture elements are contained in the discontinuity in the area of the outer wall portion of the warhead.

18. The warhead according to claim 17, wherein the discontinuity in the area of the outer wall portion of the warhead containing the multitude of first fracture elements and the multitude of second fracture elements comprises a hollow generally cylindrical portion and a hollow generally conical portion.

19. The warhead according to claim 1, wherein the warhead does not comprise any outer layer over the multitude of first fracture elements.

* * * * *